US007887463B2

(12) United States Patent
Neuberg et al.

(10) Patent No.: US 7,887,463 B2
(45) Date of Patent: Feb. 15, 2011

(54) APPARATUS FOR MULTIAXIAL INDEPENDENT LEG EXERCISE AGAINST SEPARATELY AND CONVENIENTLY ADJUSTABLE RESISTANCES

(75) Inventors: Gerald W. Neuberg, Irvington, NY (US); Jeremy B. Neuberg, Irvington, NY (US)

(73) Assignee: Neuberg et al., Irvington, NY (US)

( * ) Notice: Subject to any disclaimer, the term of this patent is extended or adjusted under 35 U.S.C. 154(b) by 213 days.

(21) Appl. No.: 12/030,268

(22) Filed: Feb. 13, 2008

(65) Prior Publication Data

US 2009/0203502 A1 Aug. 13, 2009

(51) Int. Cl.
*A63B 22/00* (2006.01)

(52) U.S. Cl. ..... 482/51; 482/70

(58) Field of Classification Search ..... 482/51, 482/52, 70, 71, 79, 146
See application file for complete search history.

(56) References Cited

U.S. PATENT DOCUMENTS

| | | | | | |
|---|---|---|---|---|---|
| 3,511,499 | A | | 5/1970 | Schawalder | |
| 3,531,110 | A | * | 9/1970 | Marchu | 482/71 |
| 4,376,532 | A | * | 3/1983 | Hunstad | 482/71 |
| 4,650,184 | A | | 3/1987 | Brebner | |
| 4,850,585 | A | | 7/1989 | Dalebout | |
| 4,861,023 | A | | 8/1989 | Wedman | |
| 4,869,496 | A | * | 9/1989 | Colombo | 482/71 |
| 4,940,233 | A | * | 7/1990 | Bull et al. | 482/112 |
| 5,232,423 | A | | 8/1993 | Hajduczek | |
| 5,284,460 | A | | 2/1994 | Miller et al. | |
| 5,391,130 | A | * | 2/1995 | Green et al. | 482/71 |
| 5,419,747 | A | | 5/1995 | Piaget et al. | |
| 5,429,567 | A | | 7/1995 | Gerschefske | |
| 5,496,235 | A | | 3/1996 | Stevens | |
| 5,496,239 | A | | 3/1996 | Kallman et al. | |
| 5,536,225 | A | * | 7/1996 | Neuberg et al. | 482/71 |
| 5,692,995 | A | * | 12/1997 | Alvarez et al. | 482/71 |
| 5,735,773 | A | * | 4/1998 | Vittone et al. | 482/52 |
| 5,792,027 | A | | 8/1998 | Gvoich | |
| 5,901,617 | A | * | 5/1999 | Hervig | 74/594.4 |
| 5,967,944 | A | * | 10/1999 | Vittone et al. | 482/52 |
| 6,036,622 | A | * | 3/2000 | Gordon | 482/51 |
| 6,042,510 | A | | 3/2000 | Miller | |
| 6,117,052 | A | | 9/2000 | Frost et al. | |
| 6,231,484 | B1 | * | 5/2001 | Gordon | 482/71 |
| 6,508,746 | B1 | | 1/2003 | Jacobs et al. | |
| 6,767,313 | B2 | * | 7/2004 | Sayce | 482/71 |
| 6,786,851 | B1 | | 9/2004 | Maresh | |
| 7,025,710 | B2 | | 4/2006 | Corbalis et al. | |
| 7,090,621 | B2 | | 8/2006 | Loane | |
| 7,115,073 | B2 | * | 10/2006 | Nizamuddin | 482/51 |

* cited by examiner

*Primary Examiner*—Fenn C Mathew
*Assistant Examiner*—Andrew M Tecco
(74) *Attorney, Agent, or Firm*—Perman & Green, LLP

(57) ABSTRACT

An exercise apparatus including a frame having a front portion and side portions, independently movable foot platforms connected to the frame, the foot platforms being movable in at least fore-aft and lateral directions, each of the foot platforms comprising a carriage and a movable portion, the movable portion being configured for elevational movement with respect to the carriage so as to provide a variety of exercises involving independent leg motion in any one, two or three axes and independently variable generally opposing resistance modules connected between the foot platforms and the frame where the variable resistance modules are configured to independently control elevational travel of the movable portion and fore-aft, abduction and adduction movement of the foot platforms and are conveniently adjustable during or before use.

7 Claims, 13 Drawing Sheets

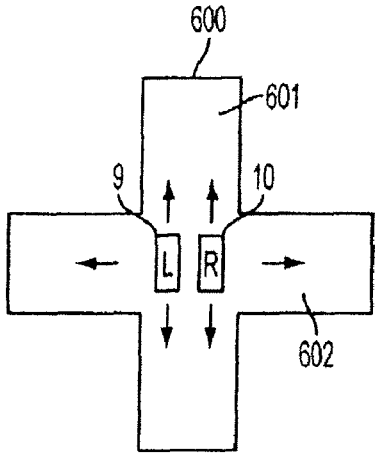
FIG. 6
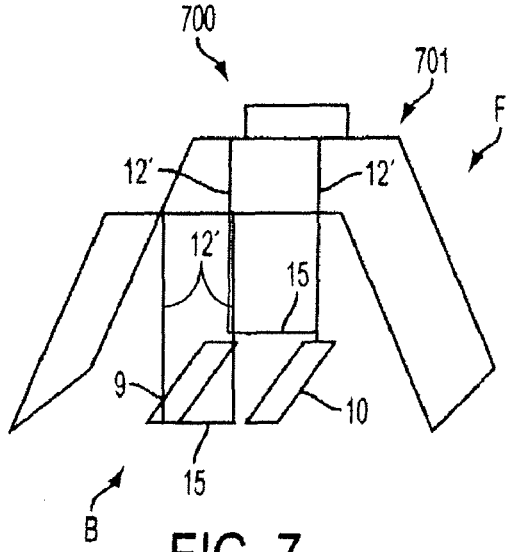
FIG. 7
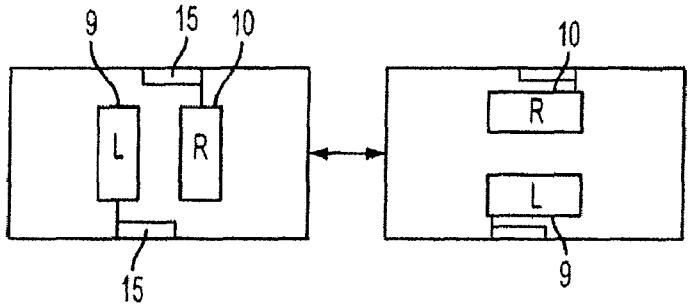
FIG. 8A FIG. 8B
FIG. 9A
FIG. 9B
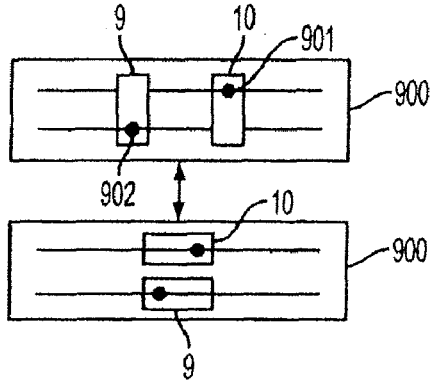

APPARATUS FOR MULTIAXIAL INDEPENDENT LEG EXERCISE AGAINST SEPARATELY AND CONVENIENTLY ADJUSTABLE RESISTANCES

BACKGROUND

1. Field

The exemplary embodiments generally relate to exercise machines and, more particularly, to weight bearing exercise machines providing lower body exercise.

2. Brief Description of Related Developments

Several types of weight-bearing exercise machines provide lower body exercise for muscle strengthening, cardiovascular conditioning, sport training and rehabilitation. This category of machines includes ski trainers, striders, steppers, elliptical trainers and exercise bikes. Most of these devices restrict motion to the midline (forward and backward, up and down), thereby focusing on the flexor and extensor muscles of the hip and leg. As a result, they largely neglect the hip adductor and abductor muscles (and other lateral stabilizers) that help coordinate lateral balance and changes of direction, which are integral to daily activities and athletics (especially skating, downhill skiing, field sports, court sports, and dance).

Some previous weight bearing exercise machines provide lateral leg exercises that engage the lateral stabilizers along with the other muscles of the legs and torso. Conventional designs for lateral leg motion vary according to whether the left and right feet move dependently (fixed stance) or independently (variable stance) and, less importantly, whether the foot platforms are supported and guided from below (by sliding or rolling on a flat or curved track), from the side (by rotating radially on a horizontal arm), or from above (by swinging on pendulum-like stems suspended side-by-side from an upright frame).

However, conventional lateral exercise machines have important limitations including a lack of full independent lateral leg motion (apart-and-together or side-to-side). Thus their restricted motions often fail to isolate or fully engage the hip adductors. Furthermore, these devices lack a mechanism for opposing resistances to abduction and adduction that are separately, incrementally and conveniently adjustable by the user. In addition, conventional weight-bearing exercise machines generally do not combine full independent lateral leg motion with a full fore-aft striding motion, or combine independent lateral, fore-aft and vertical leg motion on a single machine, which would activate a wider variety of leg muscles in combination or in sequence.

Examples of conventional weight-bearing exercise machines include various downhill ski trainers (e.g. U.S. Pat. Nos. 4,650,184; 3,511,499; 5,232,423; 7,090,621; 6,231,484; 6,117,052; 5,429,567, and Skier's Edge®), skating machines (e.g. U.S. Pat. Nos. 5,496,239; 5,284,460; 7,115,073), fore-aft striders (e.g. U.S. Pat. Nos. 4,850,585; 5,419,747; 5,496,235; 5,792,027), other lateral trainers (e.g. U.S. Pat. Nos. 5,536,255, 4,861,023, 6,042,510 and Leg Magic™), elliptical trainers (e.g. U.S. Pat. Nos. 6,786,851, 7,025,710), and other devices with limited multidirectional motion (e.g. U.S. Pat. Nos. 6,508,746, 5,429,567 and the Shuttle Balance™ system).

It would be advantageous to have a single exercise machine that provides multi-axial independent leg motion including lateral abduction and adduction (apart-and-together or side-to-side), forward and backward striding, and/or vertical flexion and extension against variable resistances that are separately and conveniently adjustable during or before use.

SUMMARY

In one exemplary embodiment, an exercise apparatus is provided. The exercise apparatus includes a frame, first and second foot carriages movably coupled to the frame by a suspension device, the suspension device being configured to provide independent lateral and/or fore-aft motion of the first and second foot carriages, a first foot platform coupled to the first carriage where the coupling is configured to allow adjustably resisted elevational travel of the first foot platform relative to the first carriage and a second foot platform coupled to the second carriage where the coupling is configured to allow adjustably resisted elevational travel of the second foot platform relative to the second carriage, wherein the first and second foot platforms are in parallel alignment with a respective one of the first and second carriage during elevational travel and the elevational travel of the first platform is independent of the elevational travel of the second foot platform.

In another exemplary embodiment, an exercise apparatus is provided. The exercise apparatus includes a frame, independently movable foot platforms connected to the frame and independently variable opposing resistance modules connected between the foot platforms and the frame where the variable resistance modules are configured to independently resist and control a multi-axial movement of each of the foot platforms.

In still another exemplary embodiment, an exercise apparatus is provided. The exercise apparatus includes a frame having a front portion and side portions, independently movable foot platforms connected to the frame, the foot platforms being movable in at least fore-aft and lateral directions, each of the foot platforms comprising a carriage and a movable portion, the movable portion being configured for elevational movement with respect to the carriage and independently variable generally opposing resistance modules connected between the foot platforms and the frame where the variable resistance modules are configured to independently control elevational travel of the movable portion and fore-aft, abduction and adduction movement of the foot platforms.

In still another exemplary embodiment, an exercise apparatus is provided. The exercise apparatus includes a frame, independently movable foot platforms connected to the frame, the movable foot platforms being moveable in at least two axes of motion and variable resistance modules connected between the foot platforms and the frame and configured to be adjustable during use of the apparatus, wherein the foot platforms and the resistance modules are configured to provide one or more of the following movement of each of the foot platforms:

- single-axis linear or arcuate movement for lateral leg abduction and adduction;
- single axis fore and aft striding movement; single axis vertical flexion-extension movement; and circular or elliptical movement in any two axes of motion,
- where the one or more movements occurs in a lateral, horizontal or midline plane of the apparatus and the path or range of travel for the one or more movements is adjustable by a user.

BRIEF DESCRIPTION OF THE DRAWINGS

The foregoing aspects and other features of the disclosed embodiments are explained in the following description, taken in connection with the accompanying drawings, wherein:

FIG. 6 is a schematic top view of a track of an exercise machine in accordance with an exemplary embodiment;

FIG. 7 illustrates a schematic view of an exercise machine in accordance with an exemplary embodiment;

FIGS. 8A and 8B are schematic top view illustrations of rotatable foot platforms of an exercise machine in accordance with an exemplary embodiment;

FIGS. 9A and 9B are schematic top view illustrations of rotatable foot platforms of an exercise machine in accordance with an exemplary embodiment;

DETAILED DESCRIPTION OF THE EXEMPLARY EMBODIMENT(S)

Figure 1:
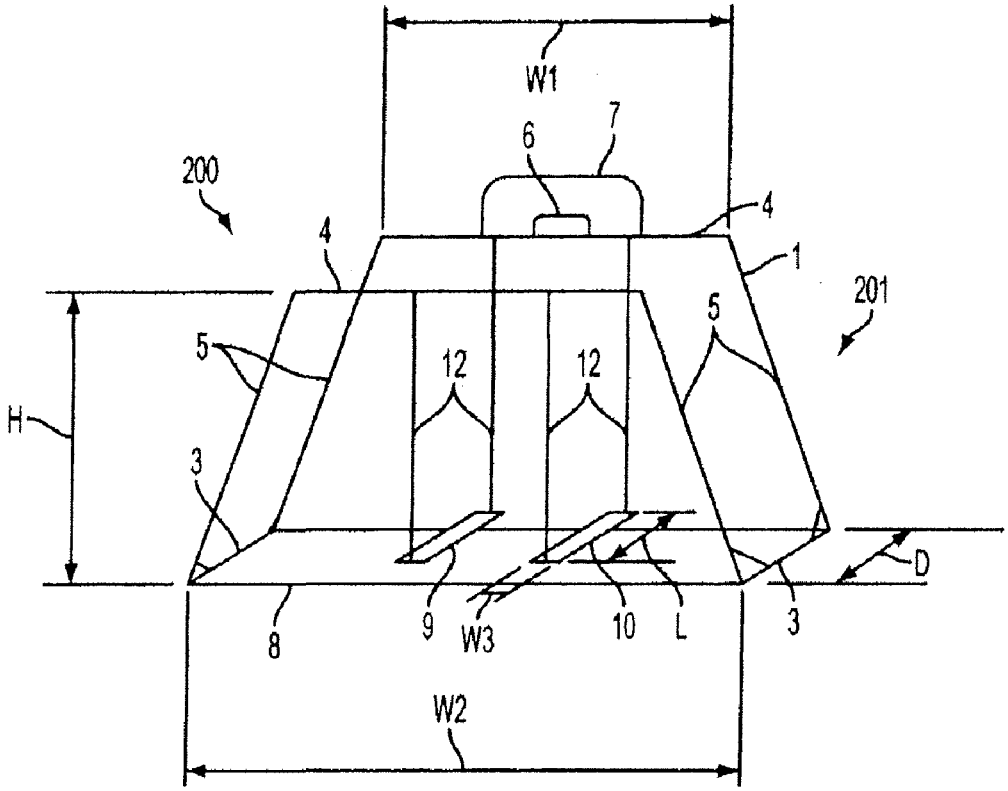
FIG. 1 illustrates a schematic view of an exercise machine in accordance with an exemplary embodiment.
Figure 2:
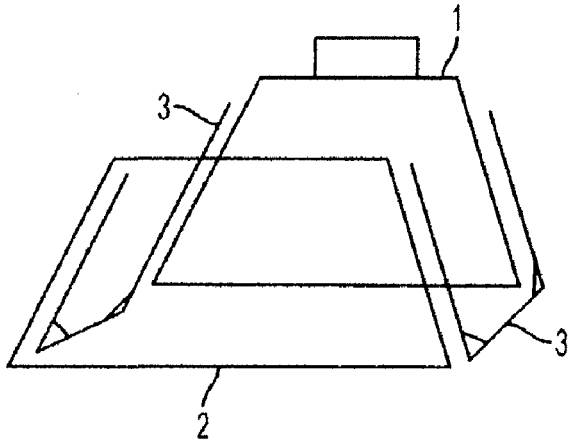
FIG. 2 illustrates an exemplary assembly of a frame of the exercise machine of FIG. 1 in accordance with an exemplary embodiment.

FIGS. 1 and 2 illustrate an exemplary exercise machine 200 in accordance with an exemplary embodiment. Although the disclosed embodiments will be described with reference to the embodiments shown in the drawings, it should be understood that the disclosed embodiments can be embodied in many alternate forms of embodiments. In addition, any suitable size, shape or type of elements or materials could be used.

The exemplary embodiments of the exercise machine 200 described herein provide for independent lateral, vertical and/or fore-aft leg motion controlled by multidirectional, generally opposing resistances that are separately, incrementally and conveniently adjustable during or before use. By providing independent leg motion in any one, two, or three axes against separately adjustable resistance modules, the exemplary embodiments provide a unique variety of lower body exercises on a single versatile machine, and provide an unprecedented degree of user control over exercise feel and intensity. The exemplary embodiments provide independent leg motion in all three orthogonal axes (e.g. the front to back or longitudinal axis, the side to side or lateral axis and vertical axis), simultaneously or in sequence. Other alternate embodiments provide independent leg motion in only one or two axes while providing new resistance mechanisms or modules and other advances by which these motions can be much better controlled by the user.

The exemplary embodiments provide for independent lateral and vertical leg motion with the addition of independent fore-aft foot motion, as on a strider or cross-country ski trainer. To achieve this combination of independent leg motion in any one, two or three axes, including but not limited to lateral abduction, adduction, vertical flexion-extension, and/or fore-aft striding, the exemplary embodiments provide left and right foot platforms that are independently supported by a frame and guided by a suitable suspension mechanism. The frame and suspension can be adapted to the desired directional functionality. For full multiaxial or omnidirectional leg motion, suspension by pendulum-like swinging stems may be incorporated, which provide independent lateral and/or fore-aft leg motion by means of any suitable joint including, but not limited to, a universal joint or a switchable axial joint for the swinging suspension. The exemplary embodiments also provide dual front and back support of the foot platforms for greater stability.

The universal joint suspension is configured to allow simultaneous or interchangeable lateral and midline motion. In other embodiments, leg motion can be restricted to one horizontal axis at a time by a switchable mechanism including, but not limited to, rotatable hinge(s) or axle(s). One setting may permit only lateral motion of the swinging stems, while another setting may permit only fore-aft motion of the swinging stems or both. With either type of joint (e.g. omnidirectional or planar), a dual front and back suspension of the swinging stems may be provided for stable fore-aft motion, and a hinged connection may be provided between the foot platforms and swinging stems, to keep the foot platforms level during fore-aft motion.

By increasing the range of independent leg motion to three orthogonal axes, the exemplary embodiments combine the actions of lateral and vertical trainers with the actions of striders, cross-country trainers, and/or elliptical trainers on one versatile device. The exemplary embodiments also create several new multiaxial motions and exercises. Briefly, independent leg exercises can be performed in any one, two or three axes at a time. Single axis exercises include, but are not limited to, lateral leg abduction and adduction (apart-and-together, or side-to-side with variable or fixed stance, as described by U.S. Pat. No. 5,536,225 ("Neuberg", which is incorporated herein by reference in its entirety), vertical stepping or rebounding, and fore-aft striding. Dual axis exercises include, but are not limited to, various combinations of simultaneous lateral and vertical motion, novel combinations of independent fore-aft and vertical motion resembling the actions of an elliptical trainer (but with variable arcs of travel), and combinations of simultaneous lateral and fore-aft leg motion. Finally, leg motions in all three axes are possible. All of these movements are described in detail below.

In the exemplary embodiments, any suitable foot support can be used including, but not limited to, a sliding track, rotary arms and swinging arms. In one embodiment, for example, a lateral base track can be configured for midline motion in any suitable manner such as by, for example, including a cross-shaped track with intersecting paths of independent lateral and fore-aft foot travel. A cross-shaped base track may allow interchangeable lateral and midline exercise without dismounting the machine, analogous to the swinging design with a universal joint. In alternate embodiments the base track may have any suitable configuration not limited to the cross-shape described herein. In other embodiments the foot platforms may rotate, for example, about 90 degrees. In alternate embodiments the foot platforms may rotate more or less than 90 degrees. A linear base track (or fixed-axle swinging design) with rotatable foot platforms may allow independent lateral motion to be converted to independent fore-aft motion, and vice-versa, by dismounting the machine and adjusting the foot platforms, analogous to the swinging design with a switchable axle. In another embodiment the machine may be configured to provide simultaneous lateral and midline motion by including horizontal rotary arms fitted with foot platforms configured for independent radial motion along each arm or fitted with extra hinges between their fixed and free ends. The exemplary embodiments also provide for independent lateral motion or combined lateral-vertical motion including, as a non-limiting example, a three-sided frame with sides and foot platforms that detach or fold flat for easy transport and storage.

The exemplary embodiments are also configured to provide adjustable multidirectional resistance. The exemplary embodiments are configured to provide separate, generally opposing resistances to independent lateral abduction and adduction, fore-aft striding, and vertical flexion-extension. The exemplary embodiments are also configured with mechanisms for separately, incrementally and easily adjusting these resistances during use. In the exemplary embodiments any suitable types of resistance module(s) can be mounted between, for example, foot platforms and frame (to resist abduction or adduction), or between one leg assembly and the other (to further resist bilateral abduction). In alternate embodiments the resistance module(s) may be mounted at any suitable location on the machine. As non-limiting examples, the resistance module(s) may include, but are not limited to, one or more of dampers, elastic members, compression or extension members, gas pistons, friction pads, magnets, flywheels or weight stacks.

For independent lateral leg motion, each leg may be provided with a set of separate, adjustable resistance modules opposing abduction or adduction, mounted between, for example, the foot suspension and the frame or at any other suitable location on the machine. In one exemplary embodiment separate sets of resistance modules to fore-aft striding may be provided. In other exemplary embodiments the lateral resistance modules may also provide fore-aft resistance. In still other embodiments the machine may be configured such that both the lateral resistance modules and fore-aft resistance modules are combined. An adjustable vertical resistance tending to raise the foot platforms, and opposed by gravity, may also be provided in any suitable manner including, but not limited to, mechanisms such as extension springs placed between, for example, the foot platforms and the top of the frame and/or compression springs below the foot platforms. In other embodiments the vertical resistance mechanisms may be located at any suitable location on the machine.

The exemplary embodiments may also provide a conveniently placed console or other means whereby each resistance can be incrementally and easily adjusted during use. The machine may be configured with separate controls for mechanical or motorized adjustment of resistance to, for example, one or more of outward abduction, inward adduction, vertical flexion-extension and fore-aft motion. The console also may include any suitable display configured to indicate parameters such as resistance settings, repetition rate and duration of exercise.

The exemplary embodiments may provide full user control over the neutral position of the two foot platforms (i.e. neutral stance) and over the intensity, feel, range and tempo of the exercises described below without having to stop exercising or dismount the device. For example, separate and incremental control of the opposing resistance modules to lateral abduction and adduction of each leg provides user control over the lateral stance and the intensity (e.g. the amount of energy and work the user expends), feel (e.g. the fluidity of movement and resistance), range (e.g. degree of movement) and tempo (e.g. speed of movement) of the lateral exercises. In one embodiment, increasing the adductor resistance relative to the abductor resistance bilaterally widens the neutral stance and increases the range and difficulty of resisted adduction. Likewise, increasing the abductor resistance relative to the adductor resistance bilaterally narrows the neutral stance and increases the range and difficulty of resisted abduction.

In another exemplary embodiment, resistance modules such as elastic members mounted, for example, between the frame and foot suspension can be increased or decreased by adding or removing resistors in parallel with one another. In still other exemplary embodiments, more convenient and precise control of resistance may be provided through variable resistors that are easily adjusted during use by mechanical or motorized means. For example, the resistance can be incrementally adjusted in any suitable manner including, but not limited to moveable attachments and/or cables at either end of the resistance mechanism (e.g. elastic or resilient members, pistons, etc. as described above), with a manual or motorized means to shorten or lengthen the resistor at a given foot position, thereby increasing or decreasing its tension throughout its working stroke. In one exemplary embodiment, control mechanisms for the resistance to abduction, adduction, forward, backward and vertical travel may be bilaterally paired, keeping the left and right leg resistance appropriately matched in any direction, so each set of resistances can be adjusted by a single control rather than separate controls for left and right legs. In alternate embodiments, separate controls may be provided so that different resistance is applied to movement of the left and right legs.

The exemplary embodiments may be configured to provide separate and convenient adjustment of opposing resistance modules to independent lateral leg motion, or to combinations of independent leg motion in any two axes, or to all three axes of motion. Thus, in contrast to conventional exercise machines, the exemplary embodiments provide for variably resisted apart-together exercise, variable stance during resisted side-to-side exercise, increased isolation and engagement of adductor muscles during both forms of lateral exercise, greater variety of resistance profiles due to the separate adjustment of the opposing resistances to abduction and adduction, convenient adjustment of resistances during use, easier initiation of side-to-side exercise (by first moving the feet apart to store energy in the resistors), better ability to train for lateral quickness using rapid changes of weight and direction, and combination fore-aft, vertical and/or lateral leg motion in a single device. As mentioned above, the exemplary embodiments may include any type of foot suspension including sliding tracks and rotary arms, as well as swinging stems for implementing the movements described herein.

Still referring to FIGS. 1 and 2 an exemplary frame 201 of the exercise machine 200 of the exemplary embodiments will be described. In one exemplary embodiment the frame 201 may be constructed of any suitable material having any suitable wall thickness, cross-sectional and/or lengthwise dimensions. In one embodiment, for exemplary purposes only, the frame 201 may be constructed of square or round tubing with an upright, generally trapezoidal front and back members 1, 2 interconnected by, for example, two U-shaped side members 3 (FIG. 1). In alternate embodiments the front and back members may have any suitable shape including, but not limited to, square and triangular. In one embodiment the front, back and each of the side members 1, 2, 3 may be separate pieces joined together in any suitable manner. For example, the members 1, 2, 3 can be bolted, snapped or welded together. In alternate embodiments two or more of the members 1, 2, 3 may be constructed as a one piece member having a unitary construction. In one embodiment, the frame may be configured to be packed flat or folded for storage and transport. The front and back members 1, 2 may have any suitable length. As a non-limiting example, the front and back members may each include a top bar 4 having a width W1 of about 36 inches. In alternate other embodiments the top bar may have a width W1 more or less than 36 inches. The top bar 4 may be supported by legs 5 that may be angled outward such that the top bar has any suitable height H. Again as a non-limiting example, the legs 5 may have a length of about 42 inches so that the top bar 4 has a height H of 40 about inches. In alternate embodiments, the legs 5 may have any suitable length and the top bar may have any suitable height H. The legs may be angled so that the base width W2 is about 48 inches but in alternate embodiments, the base may have any suitable width W2 that may be more or less than 48 inches (See FIG. 2). The side members 3 may provide a total depth D of about 36 inches. In alternate embodiments the depth D may be more or less than 36 inches. The front top bar 4 may include a centrally located resistance control console 6 and may be fitted with a fixed or moveable handbar(s) 7. A lower horizontal bar 8 may be connected to the legs 5 and/or side members 3 for additional structural support and provide additional attachment points for additional attachments, including but not limited to radios and/or additional resistance members.

Figure 3:
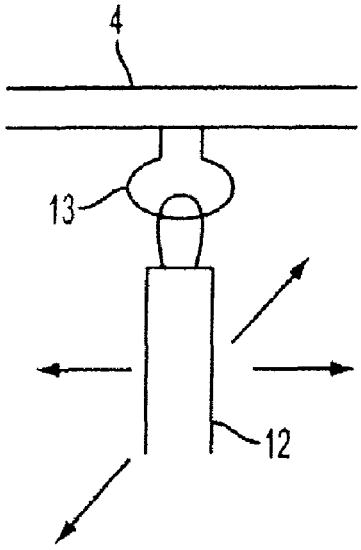
FIG. 3 illustrates a connection between members of an exercise machine in accordance with an exemplary embodiment.

The left foot platform 9 and right foot platform 10 may have any suitable length L and width W3 and be constructed of any suitable material including, but not limited to metals, plastics and composites. For exemplary purposes only, in one embodiment the foot platforms 9, 10 may have a length L of about 16 inches and a width W3 of about five to six inches. The foot platforms 9, 10 may be configured with foot straps, bindings, toe guards, heel guards and/or side guards. The foot platforms 9, 10 may be mounted side-by-side on bars or carriages 11 (see FIG. 4) that run lengthwise along the platforms 9, 10. For exemplary purposes only, the support bars 11 may have a length of about 34 inches but in alternate embodiments the bars 11 may be longer or shorter than 34 inches. The support bars 11 may be connected to and dually suspended from front and back 1, 2 by vertical stems 12. In alternate embodiments the foot platforms 9, 10 may be connected directly to the vertical stems 12. As a non-limiting example the vertical stems may have a length of about 38 inches but in alternate embodiments the vertical stems 12 may have any suitable length. Dual front and back support of the foot platforms 9, 10 provides stability with minimal torque on the suspension. The vertical stems can be pivotally supported or connected to, for example the top bars 4 in any suitable manner. In one example, as shown in FIG. 3, the vertical stems 12 are attached to the top bars 4 by swinging, axle or universal joints 13 so that the left 9 and right 10 foot platforms can swing independently in the horizontal plane (laterally and/or forward and back) against multidirectional resistances. In alternate embodiments any suitable joint may be used to connect the stems 12 to the bars 4. In one non-limiting example, the swinging joints 13 may be centered on the top bars 4 approximately 15 inches apart for a comfortable neutral stance, but in alternate embodiments the distance between joints 13 may be more or less than 15 inches. In still other embodiments the distance between the joints 13 may be adjustable. In other alternate embodiments, the joints 13 may not be centered on the top bars 4 and have any suitable spacing.

Figure 4:
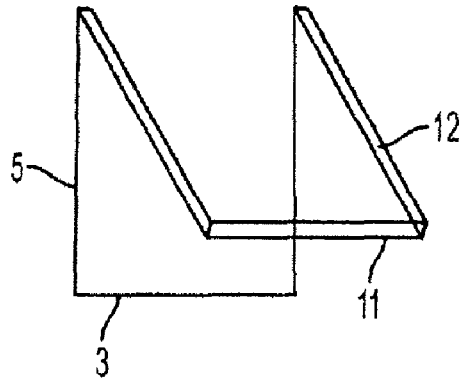
FIG. 4 illustrates a side view of another connection between members of an exercise machine in accordance with an exemplary embodiment.

The universal or omnidirectional suspension of the vertical stems 12 and foot platforms 9, 10 allows continuously interchangeable lateral and midline motion (and various combinations thereof). With foot platforms 9, 10 supported from front and back, the freely swinging stems 12 could be constructed from any suitable material including, but not limited to tubes and bars or light, flexible materials such as, for example, cables or chains. Alternately, with solid stems 12, leg motion can be restricted to one horizontal axis at a time by a switchable mechanism pivotal in one plane at a time such as a rotatable axle or two orthogonal axles in series that can be engaged alone or together or another switchable linear guiding mechanism. In the example of a directionally switchable joint, one setting may permit only lateral motion of the swinging stems, while the other permits only fore-aft motion of the swinging stems. With either type of joint (universal or planar), hinged connections may be provided between the underfoot bars 11 and stems 12 to complete, for example, a parallelogram linkage, thereby keeping the feet level during fore-aft striding as can be seen in FIG. 4. However, in alternate embodiments the foot platforms 9, 10 may be kept level during for and aft striding in any suitable manner.

Referring now to FIG. 5, independent vertical or elevational motion can be added by various designs such as by making the foot platforms vertically slidable along the swinging stems, or by making each foot platform vertically moveable relative to an undercarriage. For example, as can be seen in FIG. 5, each foot platform 9, 10 is connected to the underlying bar 11 by, for example the double parallelogram linkage 14 that keeps the foot platform 9, 10 and bar 11 in parallel alignment throughout elevational travel. It is noted that only platform 9 is shown in the Figure for clarity purposes. The vertical movement of the platforms 9, 10 in direction A may be provided in any suitable manner such as for example resistance members 29. The resistance members may be substantially similar to those described above (e.g. pistons, resilient members, etc.). In this example the resistance members 29 are shown as being located above the platforms 9, 10 but in alternate embodiments the resistance members 29 may be located on the side of the platforms, below the platforms or in any other suitable relation to the platforms. Multiaxial foot rotation can be provided, if desired. Vertical handbars could be attachable as extensions above the front swinging stems, to add upper body work to the fore-aft exercise (as commonly used on available striders and elliptical trainers) but, if too long, they might prove cumbersome during lateral exercise.

Referring now to FIG. 6 another exemplary embodiment for multiaxial motion is shown. In this exemplary embodiment the two foot platforms 9, 10 roll or slide on a cross-shaped base 600 with overlapping tracks for lateral and midline travel 601, 602. As noted above, in alternate embodiments the lateral and/or midline tracks may have any suitable shapes and are not limited to the cross shape shown in FIG. 6. In this example, lateral and fore-aft travel can be performed sequentially. For example, the lateral track could be convex, concave or flat, while the midline track could be either flat (for cross-country ski simulation) or concave (for striding with a different feel).

In another exemplary embodiments as can be seen in FIGS. 7-9, a linear swinging or sliding design is adapted for multi-directional exercise using rotatable foot platforms. FIG. 7 illustrates an exemplary swinging design in position for lateral motion, with the left foot platform 9 supported only from the back B of the exercise apparatus 700 and the right foot platform 10 supported only from the front F of the apparatus 700. The foot platforms may be supported on the frame 701 of the apparatus 700 in any suitable manner such as those described above. In this example, each platform 9, 10 includes a pair of vertical stems 12' substantially similar to stems 12 described above. However, in this example the stems 12' are paired not in the frontal plane as in FIG. 1, but rather in the lateral plane where they are joined at the bottom by, for example a hinged bar 15 to create a parallelogram linkage. FIG. 8A shows the foot platforms in position for lateral motion. In order to convert to fore-aft motion, the foot platforms 9, 10 may be swiveled or otherwise rotated about 90 degrees as can be seen in FIG. 8B. In alternate embodiments the foot platforms 9, 10 may be rotated more or less than 90 degrees. In the position shown in FIG. 8B, the foot platforms 9, 10 are supported for level fore-aft exercise by their respective pairs of the laterally paired swinging stems 12' and their connecting horizontal bar 15. In this example, the path of travel is restricted to one plane at a time to provide a more stable platform than that allowed by free swinging universal joints. Alternately, referring to FIGS. 9A and 9B, exchangeable axes of horizontal leg travel can be achieved by mounting the foot platforms 9, 10 on carriages that roll or slide along a flat or concave rectangular base track 900, where the foot platforms 9, 10 are rotatable about respective pivot points 901, 902 on the carriage. FIG. 9A shows the foot platforms in position for independent lateral motion and FIG. 9B shows them in position for independent fore-aft motion.

Figure 10:
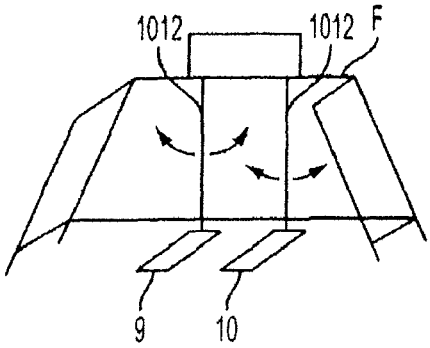
FIG. 10 illustrates a schematic view of an exercise machine in accordance with an exemplary embodiment.
Figure 11:
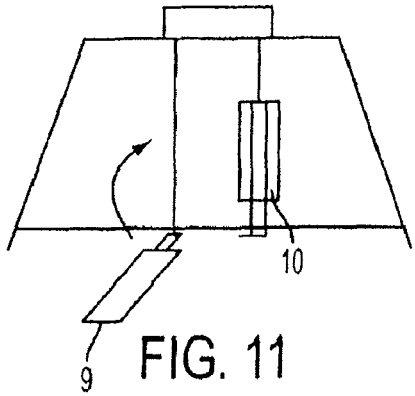
FIG. 11 is a schematic illustration of foot platforms for an exercise machine in accordance with an exemplary embodiment.
Figure 12:
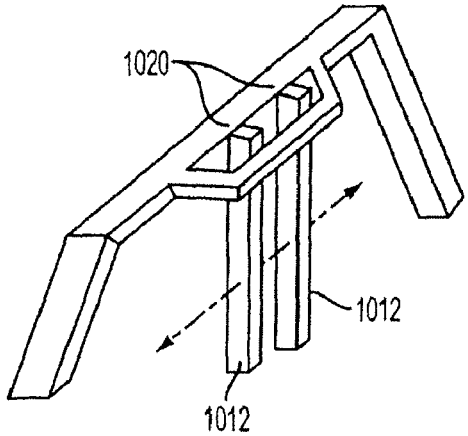
FIG. 12 is a schematic illustration of a connection between members of an exercise machine in accordance with an exemplary embodiment.

Referring to FIG. 10, a swinging design that focuses on, for example, lateral and/or vertical exercises is shown. As can be seen in the exemplary embodiment of FIG. 10, each foot platform 9, 10 is supported by a single swinging stem 1012, pivotally suspended from the front F (or back) of, for example, a three-sided frame, with the back left open for easy access. In alternate embodiments the frame may have any suitable number of sides. The user may face toward or away from the front of the frame but, when facing the front, the foot platforms 9, 10 are of a sufficient length to keep the user's knees from striking the frame. Also, as can be seen in FIG. 11 the foot platforms 9, 10 can be made foldable or removable for flat transport and storage. In this example, each of the swinging stems 1012 are pivotally mounted on the frame via a fixed axle 1020 as can be seen in FIG. 12, such that a stable foot motion is maintained within the lateral plane. In alternate embodiments the stems 1012 may be pivotally connected to the frame in any suitable manner. Fixed or moveable hand holds can be placed on the front or sides of the frame in any orientation for general support, for upper body work, and to counterbalance the lateral forces generated by side-to-side exercise.

Figure 13A:
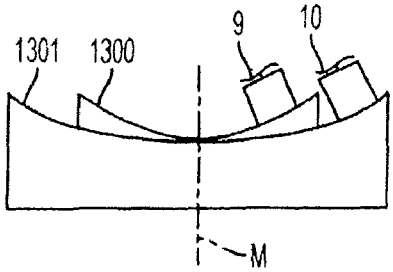
FIGS. 13A and 13B are respectively schematic side and top view illustrations of a foot platform of an exercise machine in accordance with an exemplary embodiment.
Figure 13B:
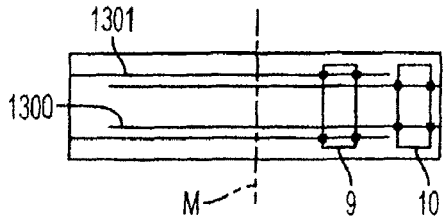
Figure 14:
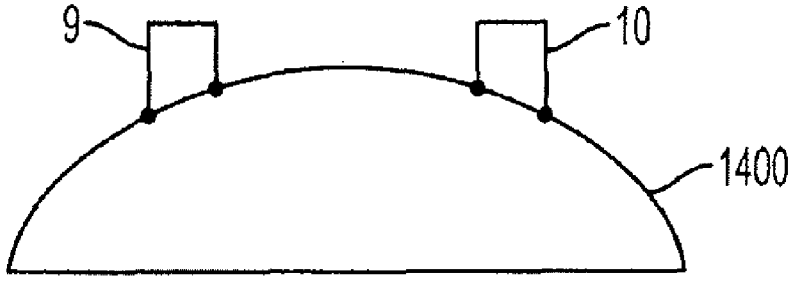
FIG. 14 is a schematic illustration of a foot platform of an exercise machine in accordance with an exemplary embodiment.

In exemplary embodiments, the exercise machine may include a concave base track, with which the inside leg may ride rather low during side-to-side exercise, or a biconcave base track, with which the legs are unable to cross the midline. However, as can be seen in FIGS. 13A and 13B, in one exemplary embodiment, the exercise machine may include two overlapping concave tracks that are configured to permit a full side-to-side exercise that crosses the midline M of the machine and yet allows the inside leg to comfortably flex while the outside leg extends as in, for example, downhill skiing. In this exemplary embodiment, the foot platforms 9, 10 travel along different tracks 1300, 1301, enabling them to describe separate but overlapping concave arcs. These overlapping arcs of motion may be achieved with the swinging stem design as described above with respect to any one of FIGS. 1, 7, 8, or 10. Similarly, referring to FIG. 14 a convex base track, having one or more tracks 1401 can also be used with, for example, rolling or sliding foot platforms 9, 10 for independent lateral motion in a manner substantially similar to that described above with respect to, for example, FIGS. 13A and 13B. The foot platforms 9, 10 of FIG. 14 may include any suitable mechanism for lateral foot rotation to keep the feet at a comfortable inward angle, as inherently provided by the swinging or concave sliding designs.

Figure 14A:
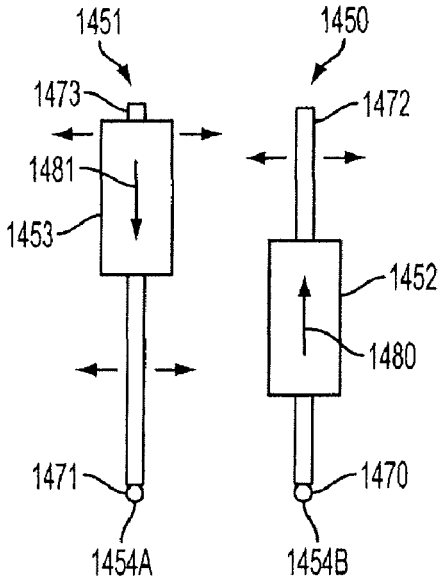
FIGS. 14A and 14B illustrate top views of rotary arms in accordance with an exemplary embodiment.

Referring now to FIG. 14A, in another exemplary embodiment the exercise machine may include any suitable number of rotary arms, such as for example rotary arms 1450, 1451. The rotary arms may be attached to any suitable point on the frame 201 in any suitable manner. For example each of the rotary arms 1450, 1451 may be hingably attached at ends 1454B, 1454A respectively, to the frame 201. The hinge(s)

1470, 1741 may be configured to allow the free end 1472, 1473 of the rotary arms 1450, 1451 to move freely in the horizontal and/or vertical planes. Each of the rotary arms 1450, 1451 includes a foot platform/carriage 1452, 1453. In one embodiment the foot platform/carriage 1452, 1453 may be substantially similar to the foot platform and carriage described above with respect to FIGS. 5A and 5B. The foot platforms/carriages 1452, 1453 may also be slidable in the directions of arrows 1480, 1481 along at least a portion of the length of a respective rotary arm 1450, 1451. It is noted that the combined movement of the foot platforms/carriages 1452, 1453 and the rotary arms 1450, 1451 provide for variable foot motions (liner, arcuate, circular, elliptical, etc.) in at least two dimensions.

Figure 14B:
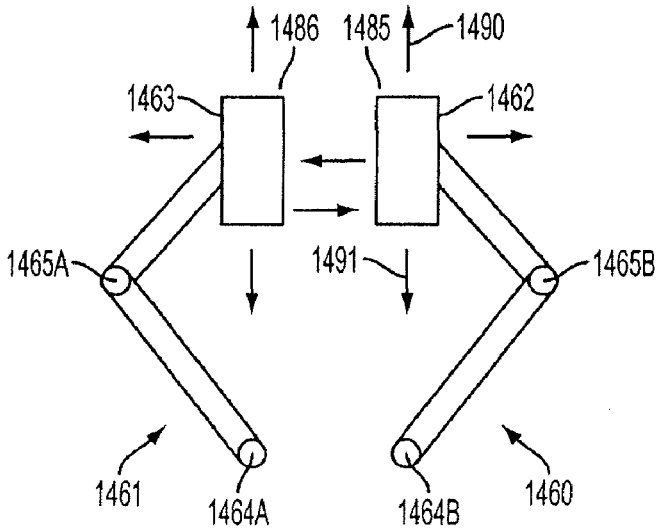

Referring also to FIG. 14B, in another embodiment each of the rotary arms may include a hinge or elbow joint located between the hinged end 1464A, 1464B and free end 1485, 1486 of a respective rotary arm 1460, 1461. Although one hinge is shown in the drawings for each of the arms, in alternate embodiments the arms may have any suitable number of hinges between the hinged end and the free end of the arms. The rotary arms 1460, 1461 each include a foot platform/carriage 1462, 1463. In one embodiment, the foot platform/carriage 1462, 1463 may be substantially similar to the foot platform and carriage described above with respect to FIGS. 5A and 5B. The elbow joints 1465A, 1465B may allow the foot platforms to move in the direction of arrows 1490, 1491, while the hinged end 1464A, 1464B of the rotary arms allow the arms to move freely (via any suitable hinge or connection) in the horizontal and/or vertical planes. It is noted that the jointed movement of the rotary arms 1460, 1461 provide for variable foot motions (liner, arcuate, circular, elliptical, etc.) in at least two dimensions. Movement provided by the foot platforms/carriages 1462, 1463 as described above further increases the number of spatial dimensions available for exercise motions.

Figure 15:
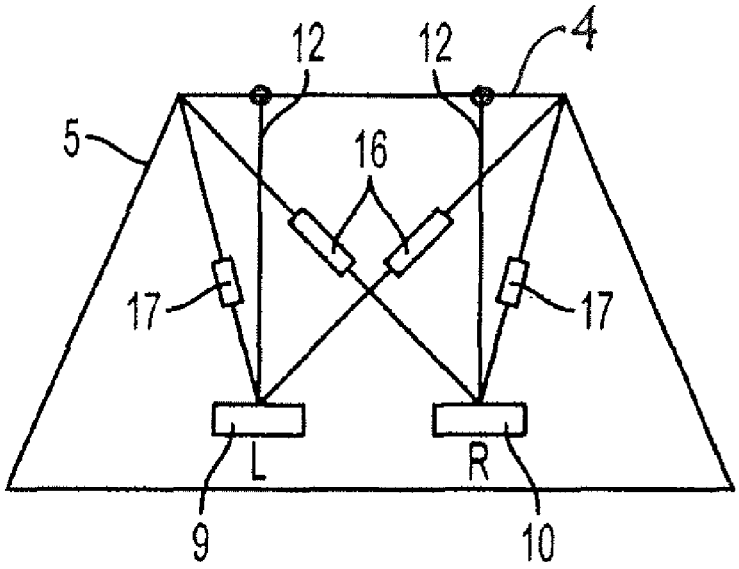
FIG. 15 is a schematic illustration of a resistance system in accordance with an exemplary embodiment.
Figure 16:
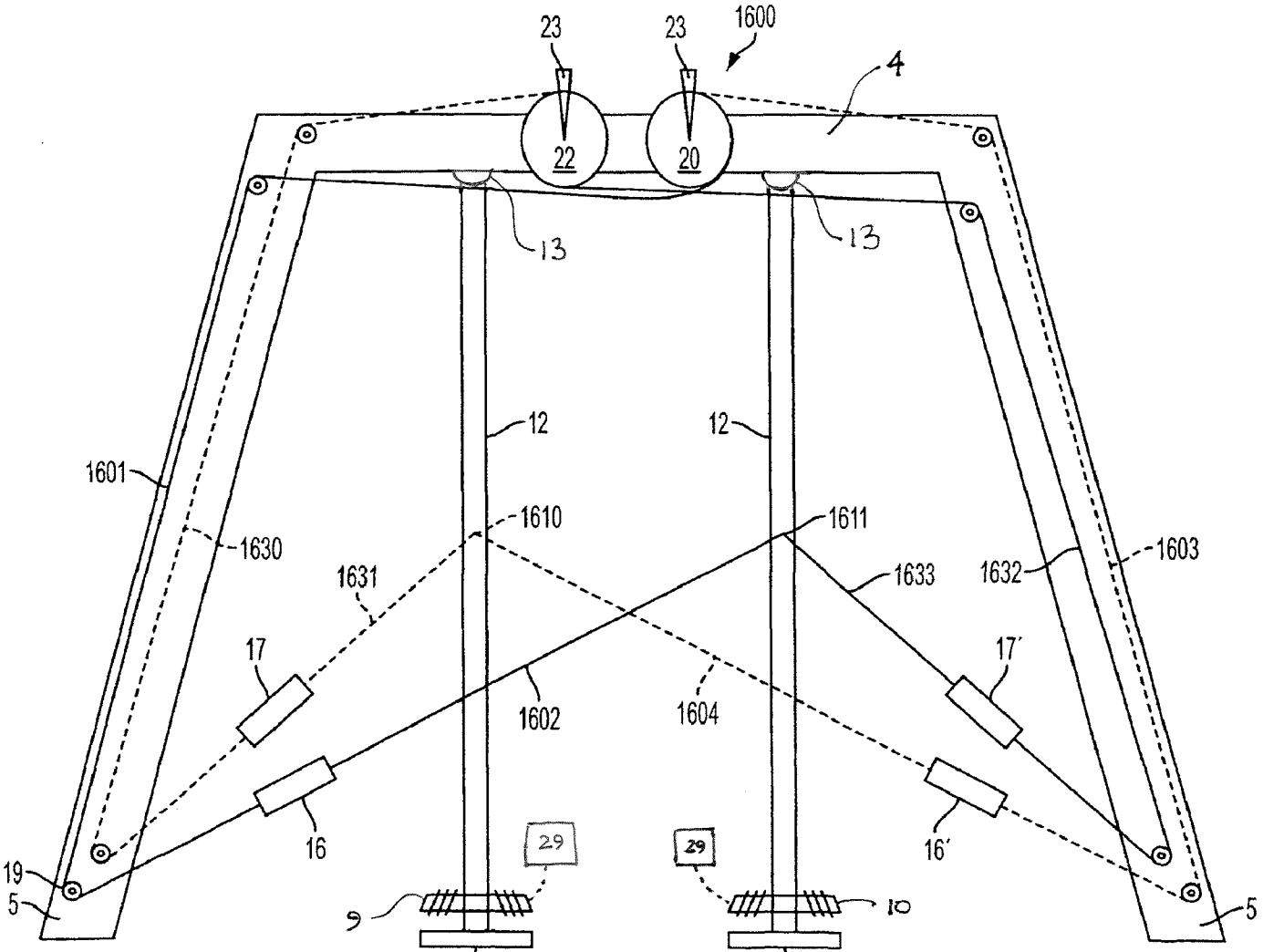
FIG. 16 is a schematic illustration of a resistance system in accordance with an exemplary embodiment.
Figure 17:
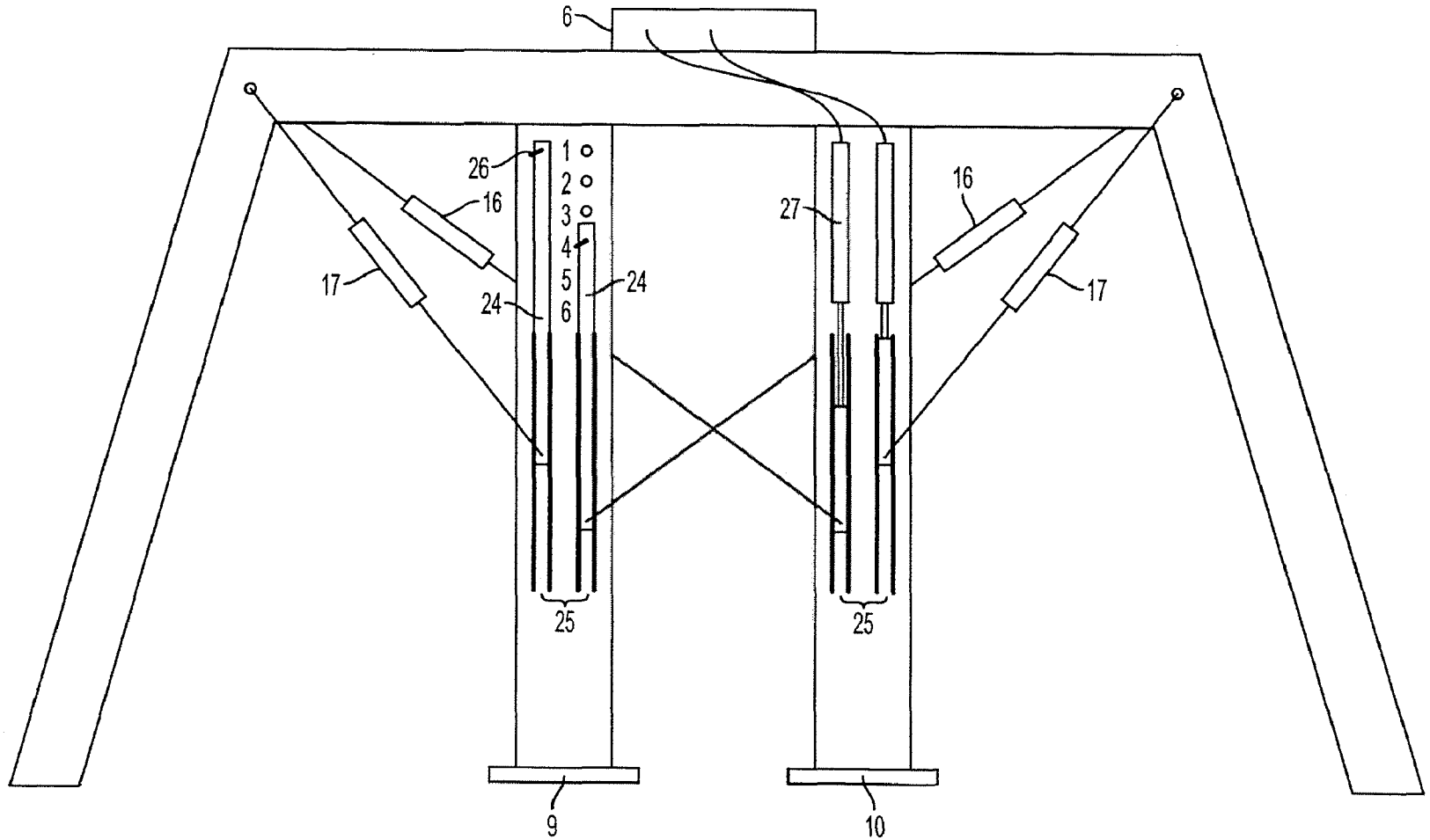
FIG. 17 is a schematic illustration of another resistance system in accordance with an exemplary embodiment.

Referring now to FIGS. 15-17 the exemplary resistance configurations for the exemplary embodiments will now be described. As shown in FIGS. 15-17, separate resistance modules to abduction 16 and adduction 17 of left or right legs may be mounted between the stems 12 and frame legs 5. Any type of resistance can be used, as described above. In one example, resistance members such as springs or elastic bands can be adjusted by adding or removing additional resistance members in parallel. In another exemplary embodiment, the resistance members could be adjusted more incrementally and conveniently by making one attachment point moveable or by attaching them via cables to an uptake or tensioning mechanism.

FIG. 16 illustrates adjustment of resistors using an exemplary tensioning mechanism 1600 for exemplary purposes only. It should be understood that any suitable tensioning mechanisms may be used to tension or relax the resistance members. Here, resistance members 16, 16' for left and right leg abduction are attached to cables 1601, 1062 and 1603, 1604 respectively. The resistance members 16, 16' are fixedly connected on one end to the swinging stems 12 at points 1610, 1611 via cables 1602, 1604 and directed on the other end via cables 1601, 1603 and pulleys 19 toward a tensioner 20. In this example the tensioner 20 may be, for example, a winch like rotary adjustment spool or any other suitable ratcheting mechanism. Similarly, resistance members 17, 17' to adduction are connected to the stems 12 by cables 1631, 1633 and are connected to tensioner 22 by cables 1630, 1632. It is noted that the tensioners 20, 22 are separately adjustable via, for example, handles 23 but in alternate embodiments the tensioners 20, 22 may not be independently adjustable. Alternately, the orientation of the resistance members 16, 16', 17, 17' could be reversed by attaching the passive end to the outer frame 5 and directing the adjustment cables via pulleys up the swinging stems 12 towards the adjustment spools or tensioners 20, 22. In one example, the handle 23 may include a ratcheting dial or motorized switch for rotating a respective spool or tensioner 20, 22 in order to tighten or loosen the resistance cables, as desired, then hold them in place so that the cable length is kept constant during exercise. Bilaterally paired resistances may be achieved by connecting left and right cables resisting motion in the same functional direction to each other or to a single adjustment element so that bilateral resistances are symmetrically matched throughout the adjustment range. Thus, bilaterally paired resistances to abduction and adduction can be adjusted separately, using only two control points, and additional controls can be added for vertical and fore-aft motion as needed.

FIG. 17 shows another exemplary adjustment mechanisms wherein lateral resistance members 16 and 17 are attached directly to slidable elements 24 situated in, for example, a linear track 25 on the swinging stems 12, rather than around pulleys to a tensioner as described in FIG. 16. The slidable elements could also be mounted at any convenient and/or suitable location on the frame rather than on the swinging stems. The slidable elements 24 could be adjusted manually with stops such as conveniently placed pins 26 (as illustrated for control of the left foot 9). Or they could be adjusted electronically, such by actuators 27 controlled from the control console 6 (as illustrated for control of the right foot 10). It is noted that the resistances can be bilaterally paired with either the electronic controls or the manual controls in any suitable manner.

Figure 18:
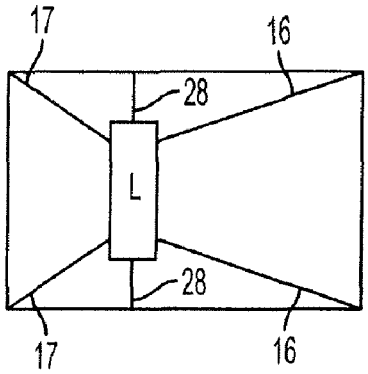
FIG. 18 is a schematic top view illustration of still another resistance system in accordance with an exemplary embodiment.
Figure 19:
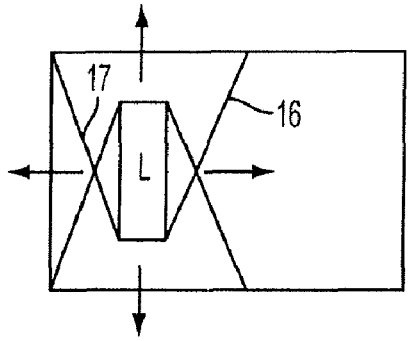
FIG. 19 is a schematic top view illustration of yet another resistance system in accordance with an exemplary embodiment.

Resistances to horizontal motion can be mounted at any suitable angles and at any suitable attachment points. For example, FIGS. 15 and 17 show resistance members angling upward from the swinging assembly to the outer frame, whereas FIG. 16 shows them angled downwards toward the outer frame. In one exemplary embodiment, if flexible swinging stems are used, resistances to abduction and adduction 16, 17 may be directed in a horizontal or slightly downgoing direction from the lower foot platforms 9, 10 to the bottom of the frame 201, to keep the swinging stems fully extended, and opposing resistances to fore-aft motion 28 also could be provided as shown in FIG. 18. A similar alignment of more or less horizontal resistance members also would be suitable for the cross-shaped base track. In still other exemplary embodiments, bilaterally symmetric resistances to abduction and adduction 16, 17 could function effectively in both lateral and fore-aft (midline) plane and may eliminate separate fore-aft resistance as can be seen in FIG. 19.

Figures 5A, 5B:
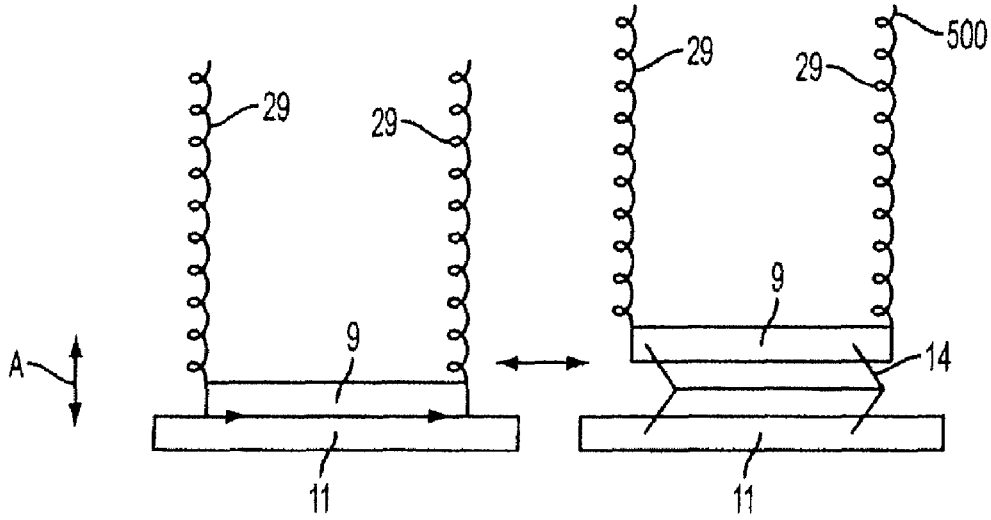
FIGS. 5A and 5B are schematic illustrations of elevational foot travel of an exercise machine in accordance with an exemplary embodiment.

Referring back to FIGS. 5A and 5B, the substantially vertically oriented resistance members 29 can be attached to left and right foot plates 9, 10 or extensions thereof. The free ends 500 of the resistance members can be moveably attached to, for example, each swinging stem 12 for direct adjustment, or attached to cables that are fed vertically to pulleys on the top of the frame, and then to their own adjustment mechanism controllable from the console in a manner similar to that shown in FIG. 16. When the resistance members 29 are loosened (or detached) as shown in FIG. 5A, the foot plates 9 and 10 may rest on their support bars 11, and the user may exercise in the "horizontal" plane. When the resistance members 29 are tightened as shown in FIG. 5B, they may raise or elevate the foot plates 9 and 10 to an elevated position, guided by, for example, the double parallelogram linkage 14. Then, when the user places weight on the foot plates 9 and 10, gravity will oppose the resistance of the resistance members 29 and return the foot plates 9 and 10 down toward the support bars 11. Thus, the resistance members 29 may be substantially stronger than the resistors 16 and 17 controlling horizontal motion and sufficiently strong enough to support the weight of a moving subject so that the foot plates 9 and 10 do not contact the support bars 11 during vertical stepping or rebounding exercises. Redundant vertical resistance members (with or without a separate adjustment mechanism) may provide an adequate range of vertical travel and resistance for heavier users, especially during fully weighted two-legged rebounding.

Figure 20:
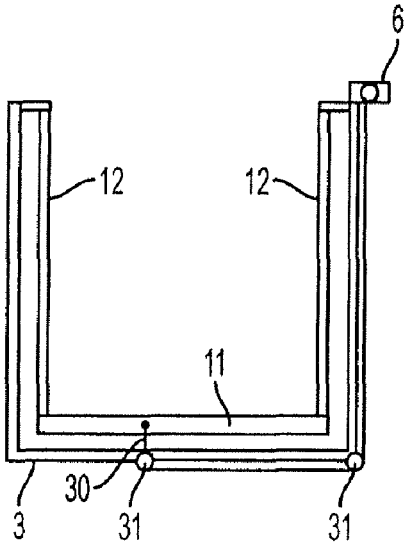
FIG. 20 is a schematic illustration of another resistance system in accordance with an exemplary embodiment.

In another exemplary embodiment shown in FIG. 20 resistance cables 30 may be attached underneath each swinging foot platform 9, 10 or support bars 11. In this example, the cable 30 is connected on one end to the support bar 11, routed around pulleys 31 mounted on the inner part of the base frame, and directed to, for example, the control console 6. In this configuration, the single resistance member 30 substantially centered beneath each foot platform would be capable of opposing foot movement in any horizontal direction, replacing separate resistance modules that independently opposed abduction, adduction and fore-aft motion. Separate vertical resistance modules 29 as shown in FIG. 5 may also be used in combination with the resistance cable 30 to provide vertical resistance. The left and right horizontal and vertical resistance modules could be paired such that only one horizontal adjustment control is required. In other exemplary embodiments, the attachment point (e.g. pulleys 31) of the cable 30 on the base frame could be moveable, biasing resistance toward one side of the frame or another.

Figure 21:
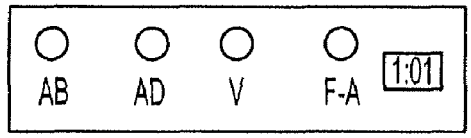
FIG. 21 is a schematic illustration of a control console in accordance with an exemplary embodiment.
Figure 22:
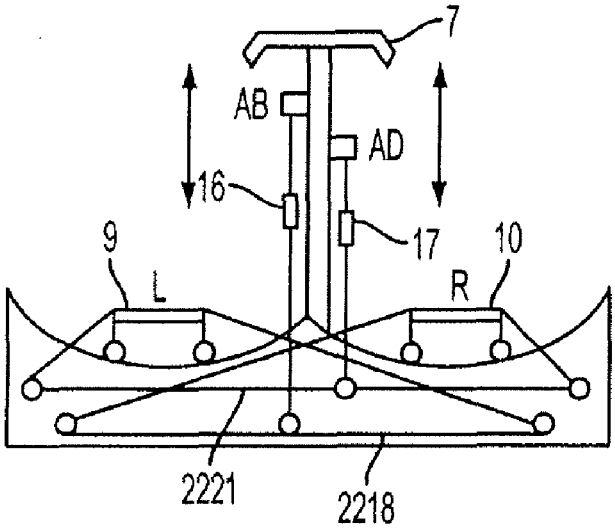
FIG. 22 is a schematic illustration of a bi-concave track in accordance with an exemplary embodiment.
Figure 23:
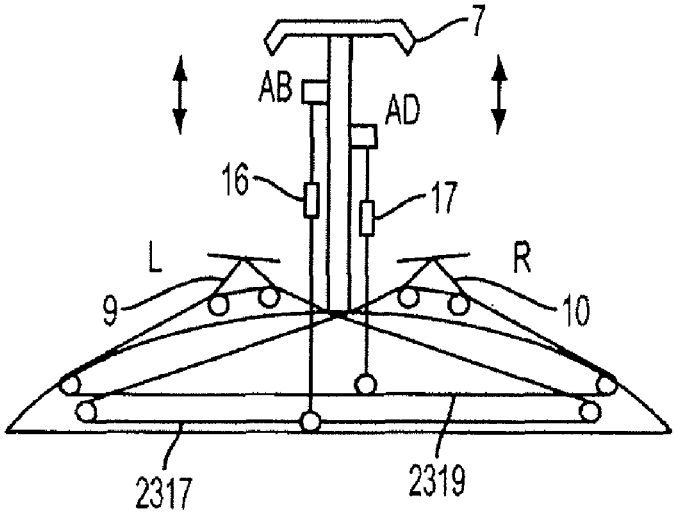
FIG. 23 is a schematic illustration of a convex track in accordance with an exemplary embodiment.

FIG. 21 shows how separate controls for resistances to abduction (AB), adduction (AD), vertical flexion-extension (V) and fore-aft striding (FA) might be arrayed on a single adjustment console, which also could include a digital display indicating parameters such as resistance settings, duration of exercise and repetition rate (which could be sensed by position or tension detectors). The resistance mechanisms described herein are applicable to other forms of resistance (e.g. magnetic) and to other embodiments, including a biconcave base track, or to the convex base track as described above, but which can be similarly adapted for independent lateral leg motion by providing two rolling carriages, each moving against separate resistances to abduction and adduction that are conveniently adjustable by the user. These improvements are shown for the biconcave base track in FIG. 21 and for the convex base track in FIG. 23. These Figures illustrate, for example, manual linear mechanisms for separate adjustment of resistances to left and right leg abduction 16 and adduction 17, mounted on a central upright, which also supports a handbar 7, though other resistance configurations and other manual or motorized configurations for adjusting the resistance members are possible as described above. The resistance members 16, 17 of FIGS. 22 and 23 are connected to the foot platforms 9, 10 through cables 2218, 2221, 2317 and 2319.

Figure 24:
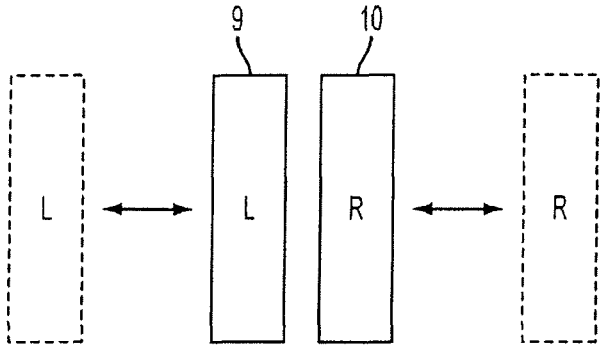
FIG. 24 is a schematic top view illustration of an apart-together exercise motion in accordance with an exemplary embodiment.
Figure 25:
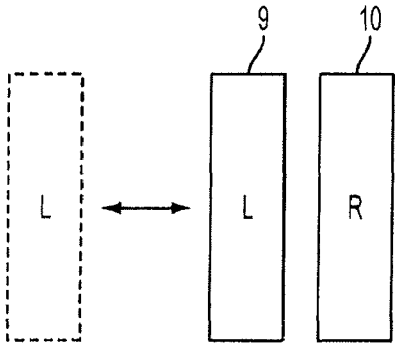
FIG. 25 is a schematic top view illustration of a single leg lateral lunge exercise motion in accordance with an exemplary embodiment.

Referring now to FIGS. 24-35 various exercise patterns in accordance with exemplary embodiments will be described. Referring to FIG. 24, symmetrical abduction and abduction against adjustable resistance (apart-together exercise) can be repeated indefinitely at a frequency selected by the user. The knees can be held straight or bent, which changes the muscular dynamics. To work the hips and knees together, cyclic abduction and adduction can be integrated with cyclic knee flexion and extension (i.e. down and out, then up and in). As can be seen in FIG. 25, lateral lunges can be done by one leg at a time. In one exemplary embodiment, one swinging stem and its corresponding foot platform, such as platform 10, may be locked in a fixed position for performing the lunges.

Figure 26:
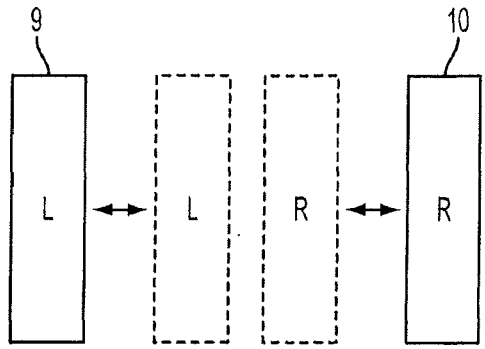
FIG. 26 is a schematic top view illustration of a foot platform stance in accordance with an exemplary embodiment.

As can be seen in FIG. 24, to emphasize a full range of resisted abduction, a narrow neutral stance is achieved when the resistance to abduction is increased relative to the resistance to adduction. Conversely, to generate a fuller range of resisted adduction, the resistance to abduction can be decreased and/or the resistance to adduction can be increased, producing a wider neutral stance as shown in FIG. 26.

Figure 27:
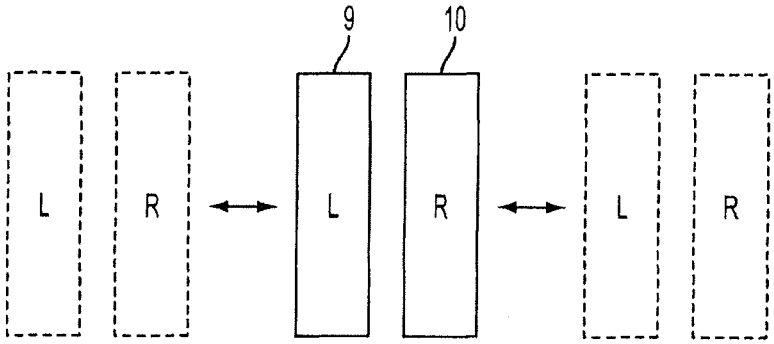
FIG. 27 is a schematic top view illustration of a side-to-side exercise motion in accordance with an exemplary embodiment.
Figure 28:
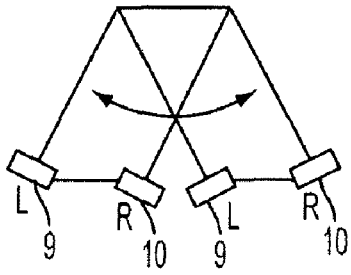
FIG. 28 is a schematic illustration of a side-to-side exercise motion with a fixed stance in accordance with an exemplary embodiment.

Referring to FIG. 27, side-to-side exercise, repeatedly crossing the midline, is achieved by simultaneous left leg abduction and right leg adduction, alternating with left adduction and right abduction, as in downhill skiing. The difficulty and feel of the exercise can be customized by separately adjusting the opposing lateral resistances as described above. During side-to-side exercise as described by Neuberg, the feet can move independently, with a variable stance, or the stance can be fixed via a removable bar affixed loosely between the foot platforms, creating a parallelogram linkage as shown in FIG. 28. Such a linkage may reduce the independent role of the adductor muscles and adductor resistances during side-to-side exercise, but the exemplary embodiments nevertheless provide improved lateral motion with, for example, a fixed stance through convenient incremental adjustment of lateral resistance. Experience with the swinging suspension has shown that lateral swing rates tend to be rather rapid during side-to-side exercise, so it is helpful to add suitable dampers such as gas pistons in parallel with the elastic resistance, in order to slow the lateral motion somewhat.

Figure 29:
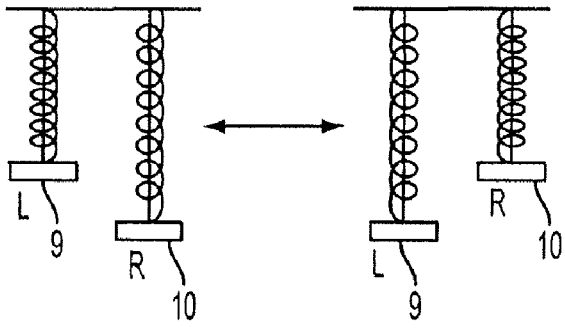
FIG. 29 is a schematic illustration of an alternating vertical flexion-extension exercise motion in accordance with an exemplary embodiment.
Figure 30:
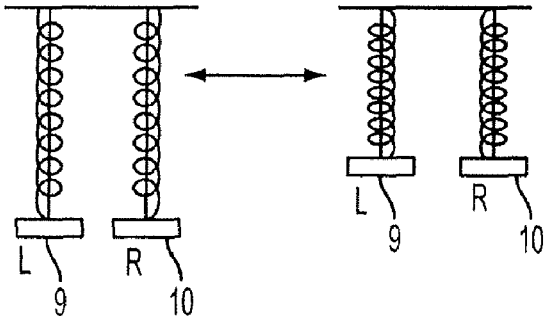
FIG. 30 is a schematic illustration of a two legged vertical rebounding exercise motion in accordance with an exemplary embodiment.

Independent vertical or combined lateral-vertical leg exercises can be performed by engaging the vertical resistance such that the neutral position of the foot platforms is elevated, and the weighted position is lower but still above the undercarriage. Resisted knee flexion-extension can be performed in a generally vertical direction with alternating legs (i.e. stepping) as shown in FIG. 29 or with symmetrical two legged rebounding as shown in FIG. 30, like bouncing on a trampoline. The latter movements provide a uniquely intense plyometric exercise. During stepping or rebounding, the lateral stance can be varied if desired. As mentioned above, heavier subjects may require extra vertical resistance to keep them from hitting the undercarriage at the low point of vertical travel.

Figure 31:
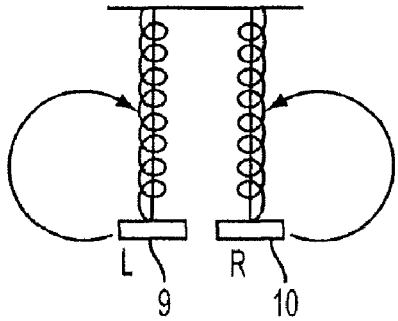
FIG. 31 is a schematic illustration of a two legged circular exercise motion in accordance with an exemplary embodiment.

In accordance with the exemplary embodiments, simultaneous lateral and vertical travel can be performed, working the hips and knees together during strenuous exercises that travel freely along an unlimited variety of elliptical arcs within the lateral plane (down and out, then up and in, or vice versa) as shown in FIG. 31. Double leg circles can be performed symmetrically or with left and right legs alternating, as on a step machine. Single leg circles are particularly smooth and comfortable. Such multiaxial exercises providing unique benefits for proprioception, balance, and coordination that are especially applicable in rehabilitation.

Figure 32:
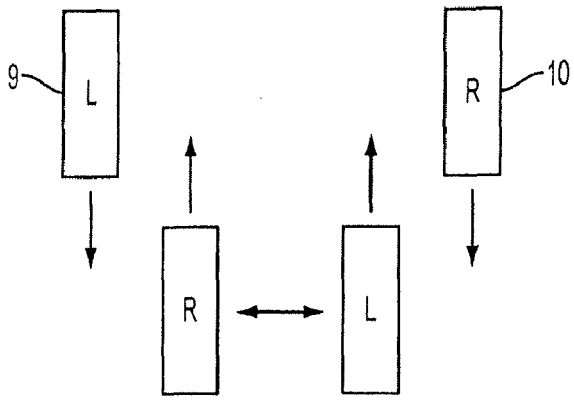
FIG. 32 is a schematic top view illustration of a fore and aft striding exercise motion in accordance with an exemplary embodiment.
Figure 33:
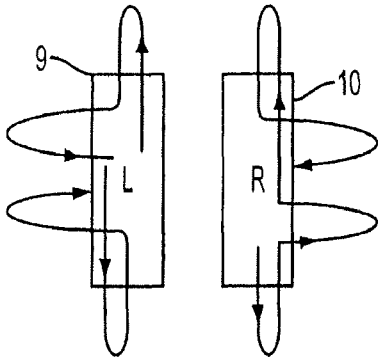
FIG. 33 is a schematic top view illustration of an exercise motion including changes of direction in accordance with an exemplary embodiment.

Referring to FIG. 32, repetitive fore-aft striding against adjustable resistance works the flexors and extensors of the hip and leg. Using the swinging design with a universal joint or the cross-shaped base track as described above, lateral and midline movements can be alternated as desired. The result is a variety of novel exercise sequences, such as a left forward-right back stride, followed by a return to neutral stance, followed by an apart-together movement, then a right forward-left back stride, and then another apart-together movement as shown in FIG. 33. In addition to providing more comprehensive and coordinated muscle and agility training, such multidirectional variety could help reduce the boredom that frequently accompanies an exercise program.

Figure 34:
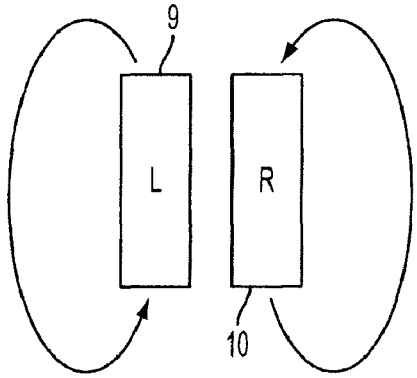
FIG. 34 is a schematic top view illustration of a arcuate exercise motion in accordance with an exemplary embodiment.

Since the universal swinging joint of FIG. 3 allows free foot motion throughout the horizontal plane, this design also provides novel combinations of resisted lateral and midline motion, including various circular horizontal arcs requiring coordination of multiple hip and leg muscles in different sequences as shown in FIG. 34. Because of this freedom of motion, the universal swinging joint provides less inherent stability during straight fore-aft and lateral exercises than the hinged joint designs (see FIGS. 7, 8, 10, 12) or base track designs (see FIGS. 6, 9, 13, 14, 22, 23), but the effort required to stabilize travel could be beneficial for multidirectional leg strength, balance and coordination. Similarly free foot motion throughout, for example, the horizontal plane can be provided if the foot carriages are supported by independent horizontal rotary arms that are hingably fixed at one end and, for example, by providing a second hinge (i.e. "elbow") between the foot carriage and the frame, or by making each foot carriage radially moveable along each rotary arm as described above with respect to FIGS. 14A and 14B.

Figure 35:
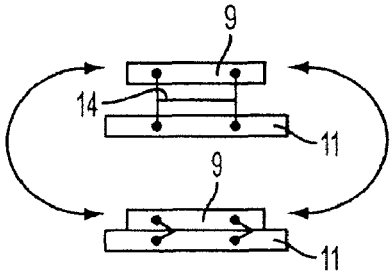
FIG. 35 is a schematic illustration of an exercise motion having variable elliptical travel in accordance with an exemplary embodiment.

More exercises are provided by the combination of independent fore-aft and vertical leg motion against adjustable resistance. If each leg is alternately cycled up and forward, then down and back, an unlimited variety of elliptical paths can be inscribed in the midline plane as shown in FIG. 35. As with conventional elliptical trainers, the direction of motion can be reversed but the variable path of elliptical travel of the exemplary embodiments gives users of different heights, builds and abilities the freedom to tailor the motion to their own comfort and liking. Incorporation of independent lateral leg travel as described above creates triaxial movement patterns.

One or more exemplary independent leg exercises described herein can be comparably performed and controlled regardless of whether the frame is of a swinging, sliding, rotating, or other design. Some exemplary exercises that can be performed in accordance with the exercise machine of the exemplary embodiments are summarized below, for exemplary purposes only, according to their directions of foot motion, and their most practical suspension designs.

| Exercises | FIG. | Lateral motion | Fore-aft motion | Vertical motion | Swinging Joint type | Base Track type |
|---|---|---|---|---|---|---|
| Apart-together | 24-26 | + | – | – | Universal or Hinged | Concave, Convex (FIG. 14), Flat or Biconcave (FIG. 22) |
| Side-to-side | 27, 28 | + | – | – | Universal or Hinged | Flat or Convex (FIG. 14) |
| Stepping & rebounding | 29, 30 | – | – | + | Universal or Hinged | Not preferred |
| Lateral leg circles | 31 | + | – | + | Universal or Hinged | Not preferred |
| Fore-aft striding | 32 | – | + | – | Universal or Hinged | Flat or concave |
| Interchangeable striding and lateral exercise* | 33 | + | + | – | Universal | Cross-shaped (FIG. 6) |
| Convertible striding or indep. lateral exercise* | 24-27, 32 | + | + | – | Hinged | Flat or concave (FIG. 9) |
| Horizontal leg circles* | 34 | + | + | – | Universal | Horizontal rotary arms (FIGS. 14a&b) |
| Varying elliptical arcs* | 35 | – | + | + | Universal or Hinged | Not preferred |
| Triaxial motion* | — | + | + | + | Universal | Not preferred |

Where "+" indicates the specified motion is applicable to exercise, "–" indicates the specified motion is not applicable to exercise and "*" indicates exercises unique to the exemplary embodiments.

It should be understood that the exemplary embodiments described above may be used individually or in any combination thereof. It should also be understood that the foregoing description is only illustrative of the embodiments. Various alternatives and modifications can be devised by those skilled in the art without departing from the embodiments. Accordingly, the present embodiments are intended to embrace all such alternatives, modifications and variances that fall within the scope of the appended claims.

What is claimed is:

1. An exercise apparatus comprising:

a frame having a front portion and side portions;

independently movable foot platforms connected to the frame, the foot platforms being movable in at least fore-aft and lateral directions, each of the foot platforms comprising a carriage and a movable portion, the movable portion being configured for elevational movement with respect to the carriage; and independently variable generally opposing resistance modules where the generally opposing resistance modules include pairs of bilaterally opposed resistance modules connected between the foot platforms and the frame where the variable resistance modules are configured to independently control opposing bilateral movements of elevational travel of the movable portion and fore-aft, abduction and adduction movement of the foot platforms.

2. The exercise apparatus of claim 1, further comprising a first independently variable opposing resistance module for controlling fore-aft and/or lateral movement of the first foot platform and a second independently variable opposing resistance module for controlling fore-aft and/or lateral movement of the second foot platform and a third independently variable resistance module for controlling the elevational movement of each of the foot platforms, wherein each of the first and second variable resistance modules are separately and incrementally adjusted from an adjustment console connected to the frame during use of the apparatus to provide control over an intensity, range, tempo and feel of exercises performed on the apparatus.

3. The exercise apparatus of claim 1, wherein movement of each of the foot platforms is omnidirectional for effecting at least circular or elliptical paths of movement of each of the foot platforms in a horizontal plane.

4. The exercise apparatus of claim 1, wherein the independently variable opposing resistance modules for each foot platform comprise a first and second resistance module, the first resistance modules being configured to pull the foot platforms together and the second resistance modules being configured to pull the foot platforms apart, where the first resistance modules are independently or concurrently adjustable from the second resistance modules.

5. The exercise apparatus of claim 4, wherein the first resistance modules are adjustable so as to provide a higher resistance than the second resistance modules for providing a neutral stance such that the foot platforms can be pushed apart against the resistance.

6. The exercise apparatus of claim 4, wherein the first resistance modules are adjustable so as to provide a lower resistance than the second resistance modules for providing a neutral stance such that the foot platforms can be pulled together against the resistance.

7. The exercise apparatus of claim 4, wherein the first resistance modules and the second resistance modules are configured such that the foot platforms can move side-to-side with a variable distance between the foot platforms.

* * * * *